United States Patent [19]

Rymarchyk et al.

[11] 4,230,274

[45] Oct. 28, 1980

[54] LANCE FOR REMOVING SKULLS FROM STEELMAKING VESSELS

[75] Inventors: Nicholas M. Rymarchyk, Wexford; Leo L. Meinert, Baden, both of Pa.

[73] Assignee: Pullman Berry Company, Harmony, Pa.

[21] Appl. No.: 922,943

[22] Filed: Jul. 10, 1978

[51] Int. Cl.[2] ..... C21C 5/32

[52] U.S. Cl. ..... 239/132.3; 75/60; 266/137; 266/225

[58] Field of Search ..... 239/132.3, 397.5; 75/59, 60; 266/135, 137, 225, 226

[56] References Cited

U.S. PATENT DOCUMENTS

| | | | |
|---|---|---|---|
| 2,564,037 | 8/1951 | Slottman | 266/137 X |
| 3,338,570 | 8/1967 | Zimmer | 239/132.3 |
| 3,346,190 | 10/1967 | Shepherd | 239/132.3 |
| 3,525,508 | 8/1970 | Berry et al. | 239/132.3 |
| 3,730,505 | 5/1973 | Ramacciotti et al. | 239/132.3 |
| 3,827,632 | 8/1974 | Rymarchyk et al. | 239/132.3 |
| 3,960,546 | 6/1976 | Rote et al. | 75/60 |
| 4,040,819 | 8/1977 | Rounds | 266/225 UX |

FOREIGN PATENT DOCUMENTS

| | | | |
|---|---|---|---|
| 1508143 | 10/1969 | Fed. Rep. of Germany | 266/135 |
| 602127 | 5/1948 | United Kingdom | 239/132.3 |
| 255306 | 3/1970 | U.S.S.R. | 266/225 |

*Primary Examiner*—Robert W. Saifer

*Attorney, Agent, or Firm*—Richard J. Myers; Stephen D. Geimer

[57] ABSTRACT

Skulls which form within the upper nose section of steelmaking vessels are removed by means of a centrally located top blowing lance designed to blow at high velocity oxygen or other gases. The lance includes laterally extending ports communicating with a central relatively wide gas chamber and the gas is directed generally laterally outwardly against the inner wall of the nose section to retard or remove the skulls.

9 Claims, 13 Drawing Figures

LANCE FOR REMOVING SKULLS FROM STEELMAKING VESSELS

BACKGROUND OF THE INVENTION

1. Field of the Invention

The present invention relates to the art of steelmaking and particularly the basic oxygen furnace process wherein oxygen is blown into the bath. More specifically the invention relates to a lance particularly designed to blow through the upper opening of a steelmaking vessel gas, oxygen, or other gases for the purpose of removing or retarding the formation of skull which generally is built up on the inner wall of the nose section of the vessel.

2. Description of the Prior Art

Some of the pertinent patents of the Prior Art are U.S. Pat Nos. 3,310,238, Mar. 21, 1967; 3,334,885, Aug. 8, 1967; 3,337,203, Aug. 22, 1967; 3,458,134, July 29, 1969; and 3,960,546 June 1, 1976. U.S. Pat. No. 3,960,546 relates to a process for removing or retarding nose skulls which form in the nose section of the steelmaking vessels. The vessel is of the bottom blow type and includes a number of tuyeres which are mounted at the upper end of the vessel in circumferentially spaced fashion. The tuyeres inject oxygen into the nose section for preventing the build up of nose skulls. The latter patent requires a plurality of pipes or tuyeres and requires the necessity of perforating the nose of the vessel in order to place the tuyeres within the structure, thus having inherent problems which are not found in the present invention. In the present invention a single lance structure is positioned centrally within the charging opening of the vessel.

SUMMARY OF THE INVENTION

The present invention involves an improved process of introducing an improved lance into the charging opening of a basic oxygen vessel and placing it into position where gas is blown generally laterally outwardly against the inner surface of the vessel nose to prevent the build up of skull or to remove the same. The lance includes a nozzle having a relatively large volume gas chamber and orifices which extend generally in a direction to blow oxygen or other gases against the throat or nose of the vessel. By virtue of the fact that the lance is supported so that it can be moved by machinery vertically in an up and down manner the entire nose or throat of the vessel can be transversed and oxygen may be delivered to all portions of the vessel wherein the nose skull build up is severe. In one embodiment of the invention the oxygen ports are slightly angled in a downwardly and outward direction. In another embodiment the lance nozzle is provided with a cupped shaped gas chamber having a plurality of downwardly and outwardly extending nozzles which project through a by-pass chamber having an intermediate horizontal wall separating the water inlet and outlet passages and communicating by means of a vertically extending opening. A further embodiment of the invention includes outlet ports which have inner concave-convex port portions communicating with a substantial large and wide central gas chamber. Another further embodiment includes ports for blowing oxygen laterally, the said ports having concave and convex end orifice portions adjacent to the outer and inner walls of the nozzle.

DESCRIPTION OF THE PREFERRED EMBODIMENT

Figure 1:
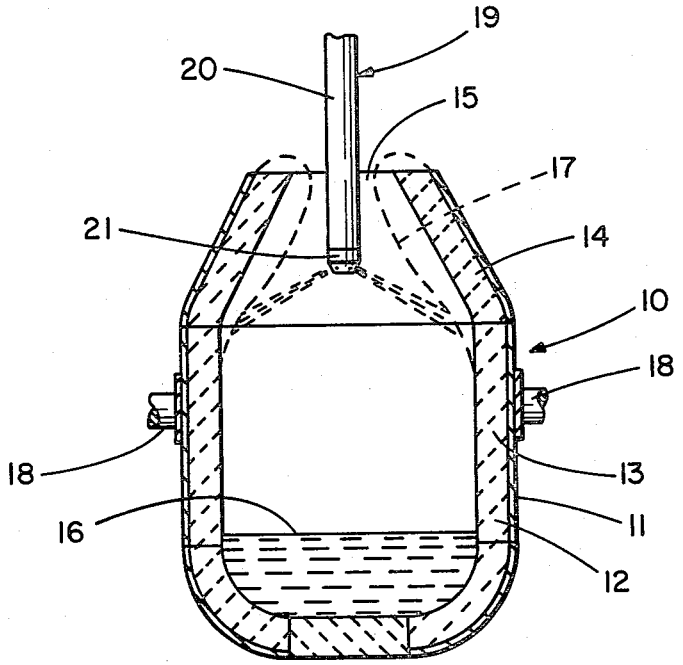
FIG. 1 is a cross-sectional view of a steelmaking vessel showing a top blow lance piping inserted for removing nose skull.

In FIG. 1 a basic oxygen steelmaking vessel 10 includes an outer steel shell 11 having a lower hearth section 12. The shell 11 is suitably lined by ceramic material indicated at 13 and the vessel 10 is so shaped at its upper end to provide an upwardly and inwardly tapering nose section 14 provided with a charging open 15. The steel bath 16 is contained within the hearth section 12 of the vessel 10. The schematic broken lines at the upper end of the vessel or nose section 14 indicate a build up of skull resulting from the steelmaking process. The present invention provides for equipment and a process to remove or to prevent the build up of the skull which is highly undesirable and can interfere with the efficient operation of the steelmaking vessel. Support trunions 18 of conventional design support the same during the steelmaking process.

In the present process the oxygen lance is inserted into the nose section by means of a suitable crane or the like which can be operated to move the lance upwardly and downwardly for removal as well as for the elimination of skull forming within the throat section. The lower end of the lance is provided with suitable porting so that gas such as oxygen or other effective mediums are blown or directed into contact with the inner wall of the nose of the vessel to eliminate the formation of skulls or to remove the same after they have been built up during the steelmaking process. By moving the lance up and down the entire area of the nose can be covered so that the skulls can be effectively removed. The process is particularly effective in that a multiplicity of ports provide for a plurality of radially spaced streams of the oxygen through a relatively short span of distance wherein the oxidation of the gases is such that the skull is quickly and effectively melted away from the inner wall of the nose section.

Figure 2:
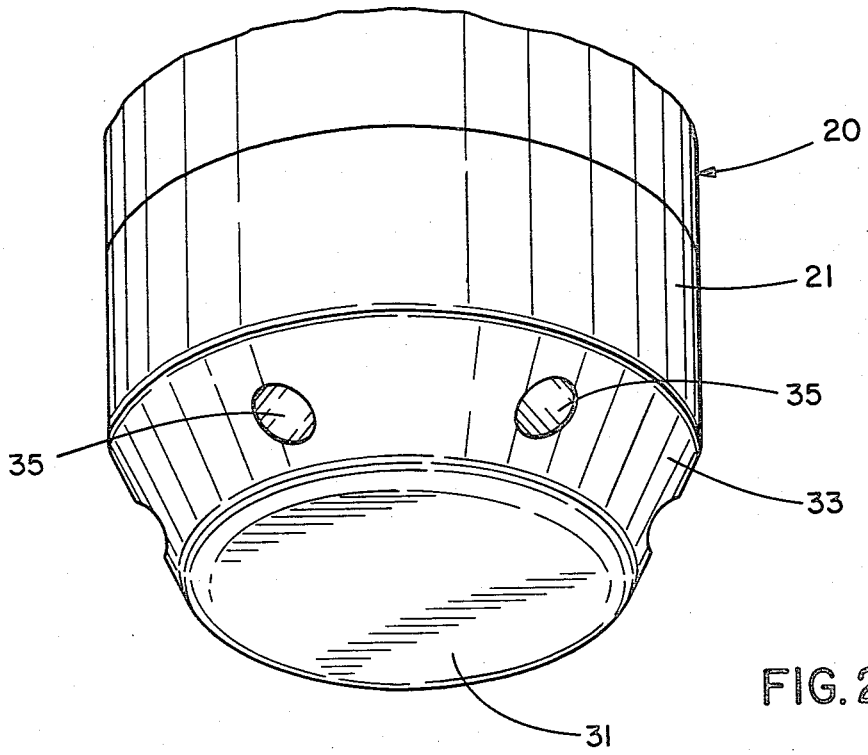
FIG. 2 is an enlarged perspective view of a nozzle attached to the lower end of lance piping.
Figure 3:
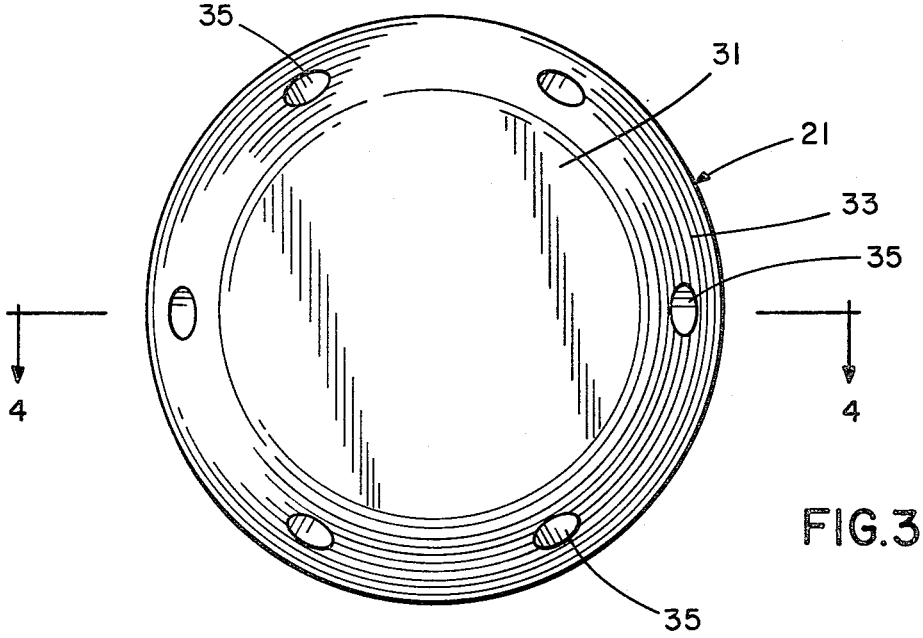
FIG. 3 is a bottom plan view of the nozzle shown in FIG. 2.
Figure 4:
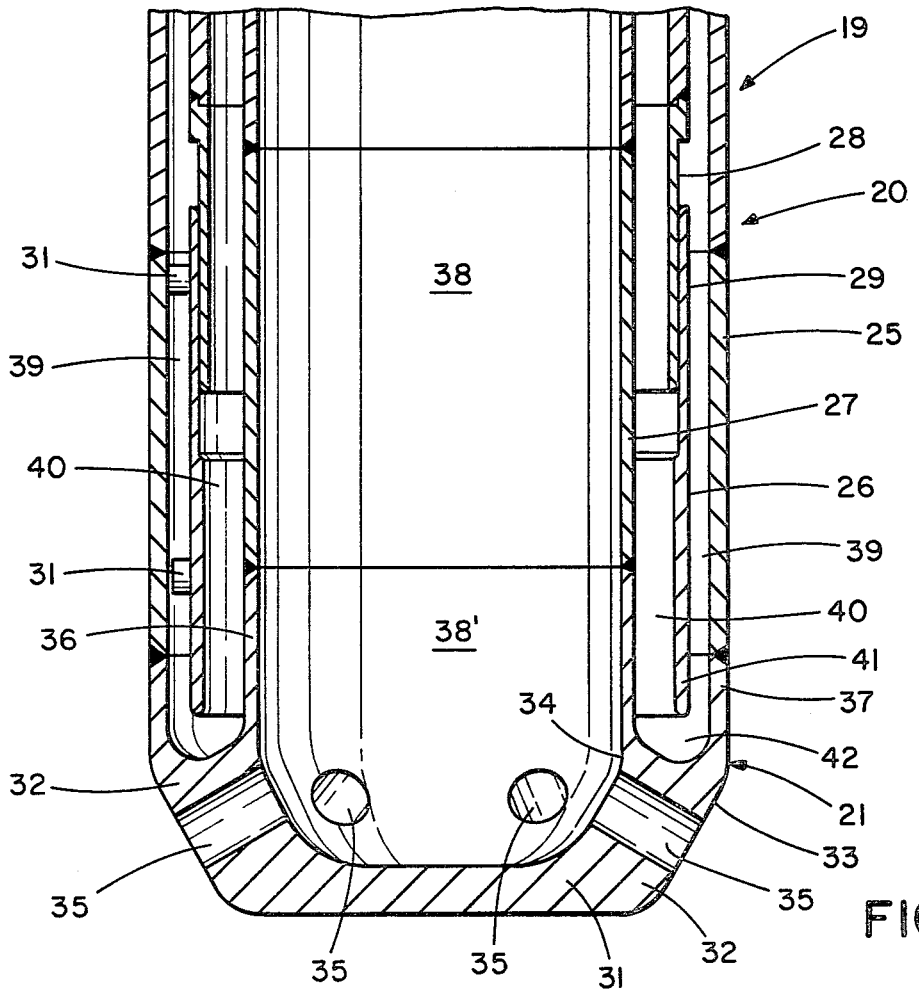
FIG. 4 is a cross-sectional view taken along the line 4—4 of FIG. 3.

FIGS. 2, 3, and 4 disclose one of the lance and nozzle designs for effectively removing skull from the nose section of steelmaking vessels. The basic piping portions of lances are the same in FIGS. 1—12 and include a vertical lance assembly 19 consisting of a piping structure generally designated at 20. In the embodiment shown in FIGS. 2, 3 and 4 a nozzle 21 is connected to the piping structure 20. The piping structure 20 includes an outer pipe assembly 25, and intermediate pipe assembly 26 and an inner pipe assembly 27. As best shown in FIGS. 4, 7, 10 and 13 the intermediate pipe assembly 26 includes telescoping lower sections 28 and 29 which permit relative sliding movement to accommodate longitudinal thermal expansion. Certain of the piping structures 20 of the lances 19 also includes suitably spacing members 30 to space the intermediate pipe assembly 26 from the outer pipe assembly 25.

The nozzle 21 as shown in FIG. 4 also is provided with a horizontal bottom wall 31, an annular converging portion 32 formed by an outer downwardly converging wall 33 and an inner downwardly converging wall 34. Oxygen ports 35 are radially spaced about the lower end of the nozzle and extend substantially perpendicular to the inner and outer walls 34 and 33. The nozzle is provided with a relatively wide gas chamber 38′ which is in alignment with and communicates with the gas conduit 38 formed by means of the inner pipe 27. The lance thus can direct oxygen or other similar gases from the gas conduit 38 through the gas chamber 38′ and downwardly and outwardly through the ports 35 against the inner walls of the nose section for eliminating or retarding nose skull occurring as a result of the steelmaking process.

As disclosed in FIG. 4 the nozzle also includes an inner skirt wall 36 which extends to and is welded to the lower end of the inner pipe 27. Further an outer skirt wall 37 is welded to the outer pipe assembly 25. Water outlet passages are designated at 39 and inlet passages at 40. The telescoping pipe section 29 is provided at its lower end with a projecting portion 41 which extends into a water by-pass chamber designated at 42.

Figure 5:
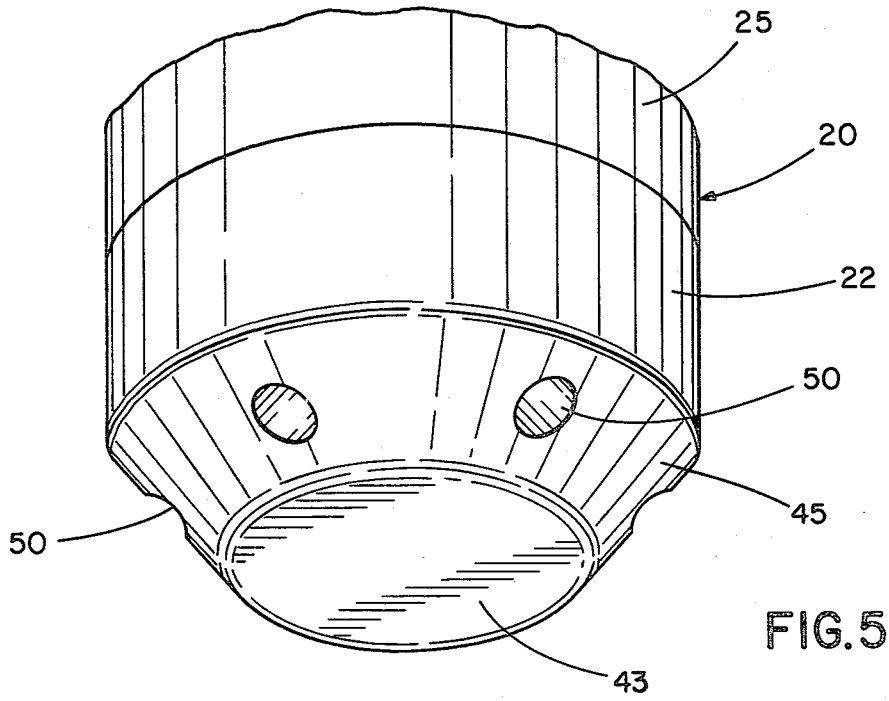
FIG. 5 is another perspective view of another embodiment of a lance nozzle.
Figure 6:
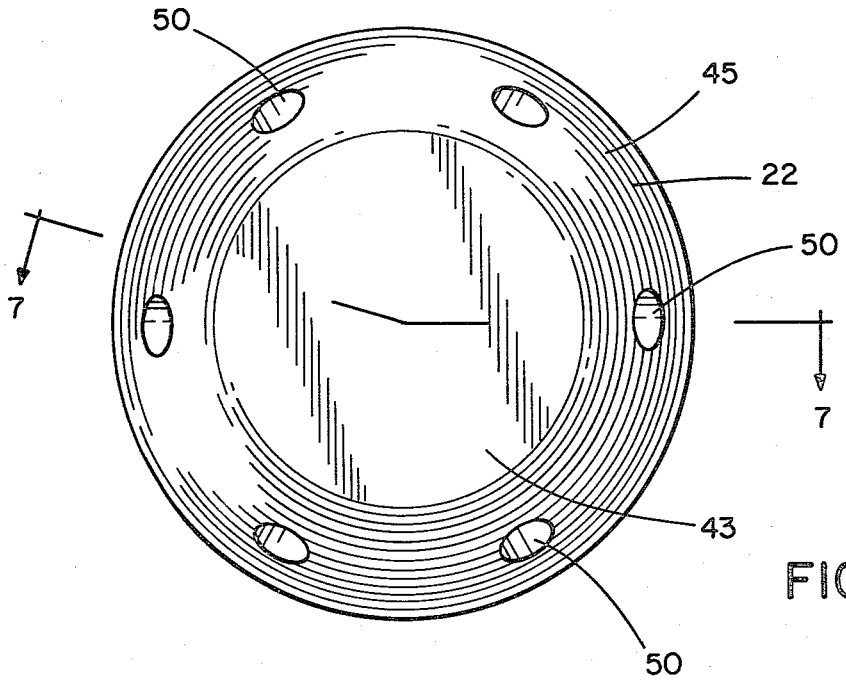
FIG. 6 is a bottom view of the nozzle shown in FIG. 5.
Figure 7:
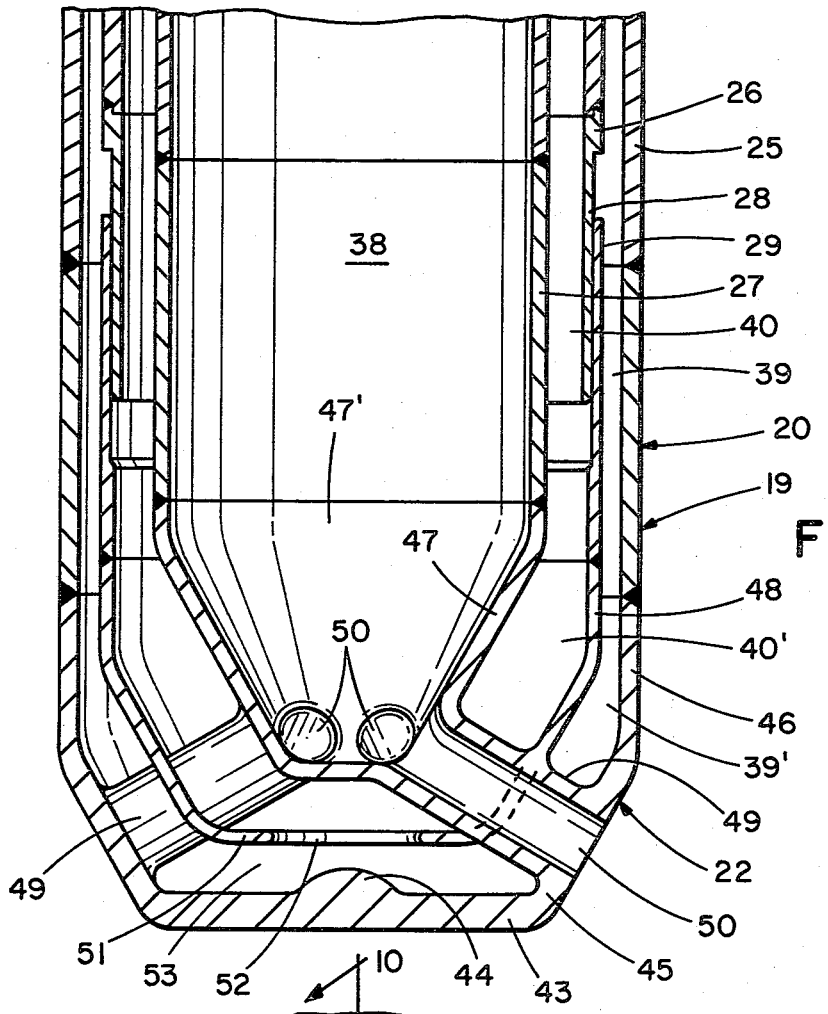
FIG. 7 is a cross-sectional view taken along the line 7—7 of FIG. 6.

The embodiment shown in FIGS. 5, 6 and 7 set forth another nozzle 22 connected to the piping structure 20. The piping structure 20 including the water inlet and outlet passages etc. have been designated by the same reference characters as the previous embodiment since the main differences lie in the nozzle construction. The nozzle 22 comprises a flat bottom wall 43 having, as best shown in FIG. 7, an upwardly projecting central dome 44. The nozzle 22 is also provided with an outer inwardly converging wall 45 of annular shape which is provided with a cylindrical outer skirt wall 46 suitably welded to the outer pipe 25. The nozzle 22 is also provided with a downwardly and inwardly converging wall 47 forming a cupped shaped gas chamber 47′. The walls 46 and 47 are separated by means of an intermediate skirt wall 48 in turn welded to the intermediate pipe assembly 26. The wall 47 is also welded at its upper end to the inner pipe 27. Thus the cupped shaped gas chamber 47′ is in communication with the oxygen conduit 38. The skirt walls 46, 47 and 48 provide for continuation passages 39′ and 40′ communicating with the passages 39 and 40. Cylindrical ports 50 extend from the gas chamber 47′ and open outwardly of the outer converging wall 45. The nozzle 22 further includes a horizontal wall 51 forming a continuation of the skirt wall 48. The wall 51 is provided with an opening 52 leading to a by-pass chamber 53. The opening 52 is placed directly over the dome shaped projection 44.

Figure 8:
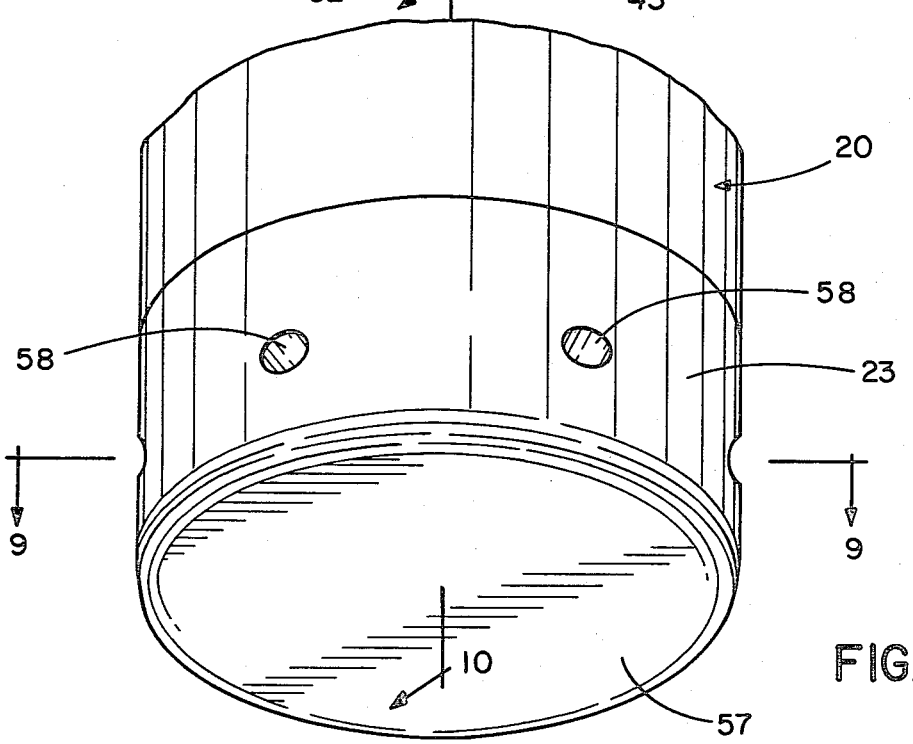
FIG. 8 is another perspective view of another embodiment of a lance nozzle and lance piping.
Figure 9:
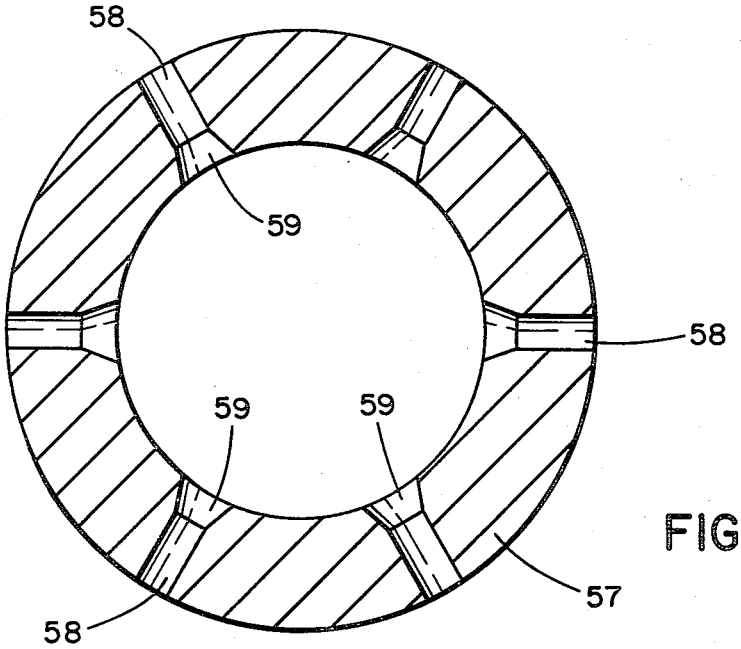
FIG. 9 is a cross-sectional view taken along the line 9—9 of FIG. 8.
Figure 10:
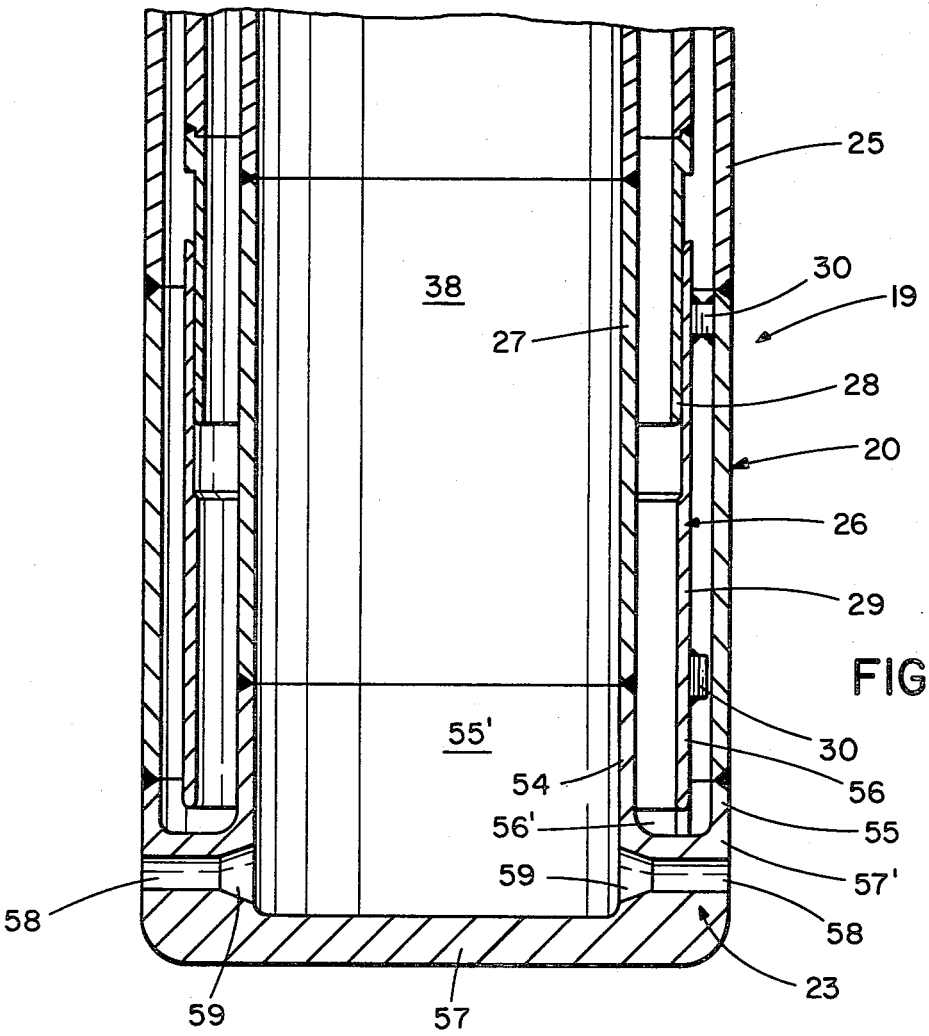
FIG. 10 is a cross-sectional view taken along the line of 10—10 of FIG. 8.

FIG. 8 discloses another nozzle 23 connected to the piping structure 20. This nozzle as best shown in FIGS. 9 and 10 includes upwardly extending skirt walls 54 and 55. The telescoping section 29 in this embodiment includes a lower projecting annular wall 56 which projects into a by-pass chamber 56′. A nozzle 23 further includes a flat bottom wall 57 having an annular outer rim 57′ to which the skirts 54 and 55 are integrally connected. The rim 57′ has extending therethrough a plurality of ports 58 as best shown in FIG. 9. Each of the ports 58 is provided with an inner port opening 59 of frusto-conical or concave-convex configuration. The shape provides for a higher velocity discharge through the main port portions 58. The gas conduit thus communicates with a gas chamber 55′.

Figure 11:
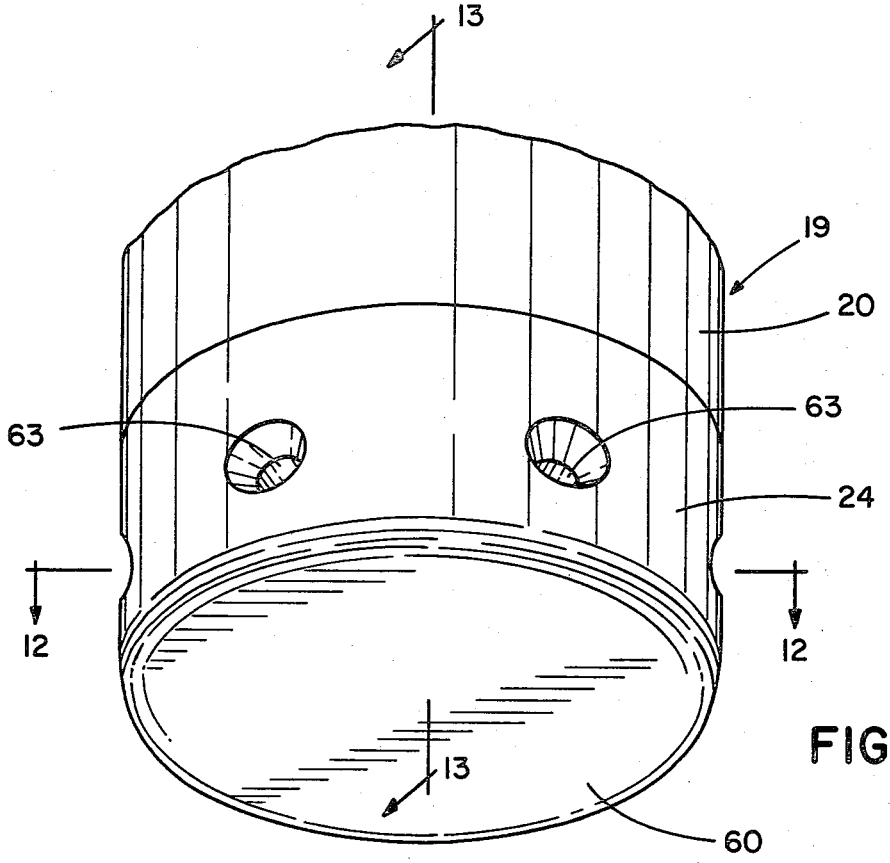
FIG. 11 is a perspective view of another further embodiment of a lance nozzle and lance piping.
Figure 12:
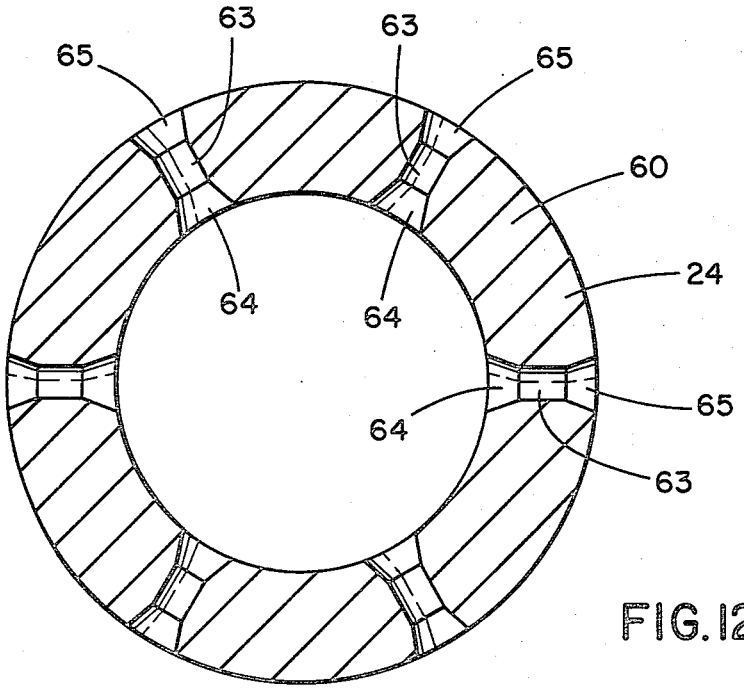
FIG. 12 is a cross-sectional view taken along the line 12—12 of FIG. 11.
Figure 13:
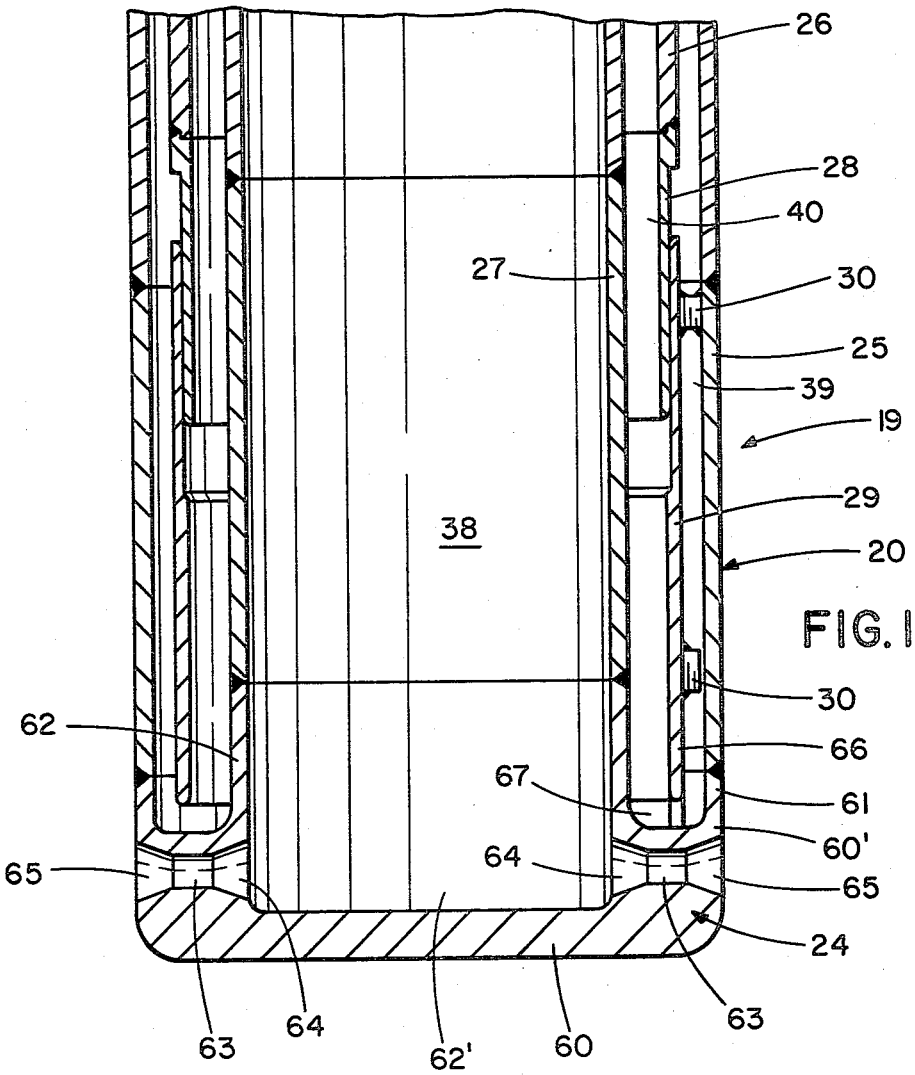
FIG. 13 is a cross-sectional view taken along the line 13—13 of FIG. 11.

In FIGS. 11, 12 and 13 another modified nozzle embodiment 24 is disclosed. The nozzle 24 is similar to nozzle 23 and includes a bottom wall 60 having an upwardly projecting annular outer rim 60′ which has supported thereon and annular outer skirt 61 and an inner skirt 62. The skirt 61 and 62 are suitably connected respectively to pipe assemblies 25 and 27. Ports 63 of a certain diameter are provided in the rim 60 and include inner and outer port portions 64 and 65 of frusto-conical shape. They also may be termed as being of concave-convex configuration. This provides for a high velocity flow upwardly from the relatively large gas chamber 62′. As best shown in FIG. 13 the lower telescoping pipe section 29 also includes an extension 66 projecting downwardly into a by-pass chamber 67 communicating with the water outlet passage 39 and inlet passage 40.

OPERATION

All of the lances are movably supported on a super structure or hoist arrangement (not disclosed) positioned above the steelmaking vessel so that they may be raised and lowered as desired relative to the nose. The structure of the ports of each of the lances is such that a high velocity flow of gas preferrably oxygen or suitably other gaseous mixtures are directed into the vessel whereupon oxidizing occurs, high temperatures are reached and the skull is melted and removed from the wall of the nose section 14. The large passages and gas chamber permit a large amount of gas under high velocity to be transmitted and directed through the ports to either prevent the formation of nose skull or to periodically burn off the accumulated amounts which are present.

What is claimed is:

1. For use with a metal refining vessel having a hearth portion adapted to contain a molten metal charge and a nose section thereabove containing an opening through which the vessel is charged, the improvement of a lance extending through said opening for injecting an oxidizing gas from said lance against an inner wall of said nose section to prevent and remove nose skull build up comprising:

an outer pipe assembly, an inner pipe assembly, and an intermediate pipe assembly, said assemblies being interconnected to provide a central gas conduit, and water inlet and outlet passages, a nozzle including a bottom and associated side wall extending generally upwardly therefrom, said nozzle being connected to said pipe assemblies including a central gas chamber communicating with said gas conduit, a by-pass chamber in said nozzle communicating with said water outlet and inlet passages, and a plurality of circumferentially spaced gas ports in said nozzle communicating with said central gas chamber and positioned extending outwardly through the side wall of said nozzle to direct a gas substantially outwardly against said inner wall of said nose section, the bottom wall of said nozzle being imperforate so that gas in said central gas chamber flows outwardly only through said circumferentially spaced gas ports.

2. The invention in accordance with claim 1, said intermediate pipe including a pair of telescoping sliding pipe sections adjacent to said nozzle.

3. The invention in accordance with claim 1, said nozzle including an inner vertical pipe portion connected to said inner pipe assembly forming said gas chamber, an outer vertical pipe portion connected to said outer pipe assembly, and said intermediate pipe assembly projecting downwardly between said inner and outer vertical pipe portions to provide said by-pass chamber.

4. The invention in accordance with claim 3, said ports extending laterally outwardly from said gas chamber below said by-pass chamber.

5. The invention in accordance with claim 4, said ports having inner frusto-conical inlet portions communicating with said gas chamber.

6. The invention in accordance with claim 5, said intermediate pipe including a pair of telescoping sliding pipe sections adjacent to said ports.

7. The invention in accordance with claim 4, said ports having an intermediate cylindrical portion, and inner and outer concave-convex portions communicating with said intermediate cylindrical portion.

8. The invention in accordance with claim 7, the inner portion increasing in area toward said gas chamber, and the outer portion increasing in area from said gas chamber.

9. The invention in accordance with claim 3, said ports having an outer cylindrical portion, and a concave-convex cylindrical inner portion increasing in area toward said gas chamber.

* * * * *